US007600851B2

(12) United States Patent
Kanda

(10) Patent No.: US 7,600,851 B2
(45) Date of Patent: Oct. 13, 2009

(54) PRINTING HEAD AND INK JET PRINTING APPARATUS

(75) Inventor: Toru Kanda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 512 days.

(21) Appl. No.: 11/477,349

(22) Filed: Jun. 30, 2006

(65) Prior Publication Data

US 2007/0008378 A1 Jan. 11, 2007

(30) Foreign Application Priority Data

Jul. 8, 2005 (JP) ..... 2005-200148

(51) Int. Cl.
*B41J 2/15* (2006.01)

(52) U.S. Cl. ..... 347/20; 347/26; 347/71; 347/84

(58) Field of Classification Search ..... 347/85, 347/86, 20, 26, 71, 84
See application file for complete search history.

(56) References Cited

U.S. PATENT DOCUMENTS

| | | | | |
|---|---|---|---|---|
| 5,126,768 | A | 6/1992 | Nozawa et al. | 346/140 R |
| 5,332,466 | A | 7/1994 | Nozawa | 156/633 |
| 6,000,777 | A | 12/1999 | Nozawa et al. | 347/20 |
| 6,155,677 | A | 12/2000 | Kitani et al. | 347/65 |
| 6,257,703 | B1 | 7/2001 | Hirosawa et al. | |
| 6,557,989 | B1 * | 5/2003 | Hirosawa et al. | 347/87 |
| 6,659,591 | B2 | 12/2003 | Sato et al. | |
| 2007/0008378 | A1 | 1/2007 | Kanda | 347/54 |

FOREIGN PATENT DOCUMENTS

| | | |
|---|---|---|
| JP | 10-44420 | 2/1998 |
| JP | 2002-19119 | 1/2002 |

* cited by examiner

*Primary Examiner*—Manish S Shah
*Assistant Examiner*—Laura E Martin
(74) *Attorney, Agent, or Firm*—Fitzpatrick, Cella, Harper & Scinto

(57) ABSTRACT

In spite of relative deformation between a printing element substrate and a supporting member due to a change in temperature of a printing head, the printing quality is stabilized, and the printing head is not damaged. In detail, as the temperature of the supporting member and the printing element substrate, which are adhered to and fixed to each other in an expanded state, falls to the room temperature, the supporting member contracts significantly more than the printing element substrate, and a stress relation is caused to be present between the respective members. At this time, ribs are deformed in the direction of widening the ribs, which is the direction toward the outside of the printing element substrate, whereby the above-described difference in deformation can be absorbed, and influence on the printing element substrate can be relieved.

6 Claims, 10 Drawing Sheets

PRINTING HEAD AND INK JET PRINTING APPARATUS

BACKGROUND OF THE INVENTION

1. Field of the Invention

The present invention relates to a printing head for ejecting ink and an ink jet printing apparatus that carries out printing using the printing head, and in particular relates to a head configuration to cope with deformation of component members of a printing head due to thermal load applied to the corresponding printing head.

2. Description of the Related Art

Various types of printing heads have been known. FIG. 9A and FIG. 9B are perspective views showing a print cartridge, in which a printing head and an ink container according to a prior art example are integrally composed, when being observed from the underside of the cartridge on which nozzles are arrayed, and from the upside opposed thereto, respectively.

In FIG. 9A and FIG. 9B, the print cartridge 601 is such that the printing head portion including a printing element substrate 702 and an ink container portion, in which ink is stored, are composed to be integral with each other. The printing element substrate 702 is composed of a heater operating as an energy generating element for converting electric energy to thermal energy, a substrate provided with circuit wiring for supplying electric energy supplied from the printing apparatus body to the heater, and a nozzle plate provided with a flow path for supplying ink to the heater and an ejection orifice through which ink is ejected.

In the present prior art example, one printing element substrate 702 is provided with ejection orifice arrays 703, 704, and 705 for ejecting inks of three colors which are yellow, magenta, and cyan, respectively.

An electric wiring substrate 706 is provided with wirings for transmitting electric signals from the printing apparatus body to the printing element substrate 702, and is provided with an external signal-inputting terminal 707 for inputting electric signals from the printing apparatus body at the end part thereof. The end part, at the side opposite to the external signal-inputting terminal 707, of the electric wiring substrate 706 is electrically connected to two end faces of the printing element substrate 702. And, the electrical connecting portion is covered with a sealing member 708, so that the electrical connecting portion is protected from ink that may be adhered to the surface of the printing head portion.

The ink container portion in which ink to be supplied to the printing element substrate 702 is stored is formed so that a cover 710 is provided on a casing portion 709 and partitions (not illustrated) for dividing ink-by-ink chambers are provided inside the casing. Accordingly, the ink storing portion for individually storing inks of respective colors consisting of yellow, magenta and cyan is constructed. Ink absorbers for retaining inks are accommodated in the ink storing portions of these ink colors, respectively. In addition, ink supplying path for each of colors of ink is provided on the bottom portion of the casing portion 709. Ink can be supplied to the printing element substrate 702 via these ink supplying paths. The ink supplying paths are provided with a filter by which foreign substances can be prevented from entering the ejection orifices.

FIG. 10 is a sectional view taken along the line X-X in FIG. 9A, and shows the configuration of the printing element substrate of the printing head portion and the surroundings thereof. In FIG. 10, the printing element substrate 702 is illustrated in a state where the nozzle plate is removed and a heater, etc., on the same substrate is omitted. A supporting substrate 802 for supporting the printing element substrate 702 is provided with an ink supplying port 803 for supplying inks of respective colors, which are accommodated in the ink containers. The supporting substrate 802 is molded by using an alumina material and polishing the same. Accordingly, the printing element substrate 702 is adhered and fixed at high accuracy. Further, the supporting plate 804 fixes and supports the electric wiring substrate 706 and is made of the same material as that of the supporting substrate 802. A sealing material 805 such as resin is used to seal a portion between the printing element substrate 702 and the supporting plate 804. One of the reasons is to protect the wall of the printing element substrate 702 from ink. It is common that thermo-hardening type resin, which is comparatively easily handled in the production process, is used for the sealing material.

Now then, in the above-described printing head, there may be a case where the printing head is influenced by heat in production and actual use, and the head composing member is subjected to deformation. To cope with such deformation, various constructions have been conventionally employed. In Japanese Patent Application Laid-open No. 10-044420 (1998), it is described that the printing element substrate is adhered to and fixed at a supporting member via a supporting substrate whose thermal properties are almost the same as those of the printing element substrate. This construction allows deformation and breakage of the head to be prevented, which are caused by a difference in the thermal expansion ratio due to a change in temperature of the composing member of the printing head such as the printing element substrate. In addition, another composition for preventing harmful thermal effects such as deformation in the printing head has been well known, which prevents a difference in the linear expansion ratio by adhering a supporting substrate such as alumina between the printing element substrate and the supporting member.

Also, Japanese Patent Application Laid-open No. 2002-019119 discloses the printing element substrate and the supporting member thereof employing materials whose linear expansion ratios are equivalent to each other. According to this construction, it is possible to reduce the thermal deformation due to a difference in the thermal expansion ratio. Further, in order to increase the rigidity of the printing element substrate, it can be considered that the thickness is increased, or the surface area thereof is further widened to withstand against the thermal deformation.

However, in any one of the above constructions, such a problem is brought about, which increases the production costs of the printing head. To the contrary, such a type in which a resin material is used for the supporting member has an advantage in that it can be inexpensively produced. However, it has a problem regarding the thermal deformation as described below.

That is, where the supporting member of a resin material and the printing element substrate are adhered together by a thermal hardening type adhesive agent, the hardening temperature is made higher than the room temperature. That is, the supporting member and the printing element substrate are adhered to each other in a state where they are further expanded than in the room temperature, and after they are adhered, the respective members are caused to shrink with a lowering in the temperature of the printing head. In this case, where the supporting member is a resin material as described above, the linear expansion ratio of the supporting member is larger than that of, for example, a silicon material of the printing element substrate. Therefore, the shrinking ratio of the supporting member becomes larger than that of the printing element substrate when the temperature of the printing head is lowered after adhesion. As a result, a dimension change of the supporting member becomes greater than that of the printing element substrate when the temperature of the printing head immediately after the adhesion gets back to the room temperature, and then a stress is caused between the printing element substrate and the supporting member. In this case, there may be a case where the printing element substrate is greatly deformed without resisting stress generated. And, the ejecting direction of ink that is ejected from a printing head subjected to such deformation is biased, and the landing position of ink shifts to cause the printing quality to be lowered. Further, there may be a case where the members that compose the printing head such as the printing element substrate are broken by the deformation.

In addition, a similar problem occurs when the temperature of the printing head rises during a printing operation. When the temperature of the printing head rises by an ejecting action during printing, the printing element substrate and the supporting member expand to cause their dimensions to be increased. As described above, the linear expansion ratio of the supporting member is larger than that of the printing element substrate, and then a change in the dimension of the supporting member becomes larger. As a result, there may be a case where stress is brought about between the printing element substrate and the supporting member, and a problem similar to the above occurs.

SUMMARY OF THE INVENTION

An object of the invention is to provide a printing head which is capable of stabilizing the printing quality and is not subjected to breakage, in spite of relative deformation caused between a printing element substrate and a supporting member due to a change in temperature of the printing head, and an ink jet printing apparatus using the same printing head.

In the first aspect of the present invention, there is provided a printing head formed by adhering a printing element substrate provided with an energy generating element for generating energy used for ejecting ink to a supporting member, where thermal expansion ratios of the printing element substrate and the supporting member are different from each other, the printing head comprising:

a rib for dividing a hollow portion formed inside the supporting member from the outside of the supporting member, the rib being provided at a part of a portion where the supporting member is adhered to the printing element substrate, wherein the printing element substrate is adhered to the supporting member in a state where an upper surface of the rib inclines in a direction toward an outside of the printing element substrate.

In the second aspect of the present invention, there is provided a printing head formed by adhering a printing element substrate provided with an energy generating element for generating energy used for ejecting ink to a supporting member in which an ink supply path for supplying ink to the printing element substrate is provided, where thermal expansion ratios of the printing element substrate and the supporting member are different from each other, the printing head comprising:

a rib for dividing a hollow portion formed inside the supporting member from the outside of the supporting member, the rib being provided at a part of a portion where the supporting member is adhered to the printing element substrate.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Hereinafter, a detailed description is given of embodiments of the invention with reference to the drawings.

Embodiment 1

Figure 1:
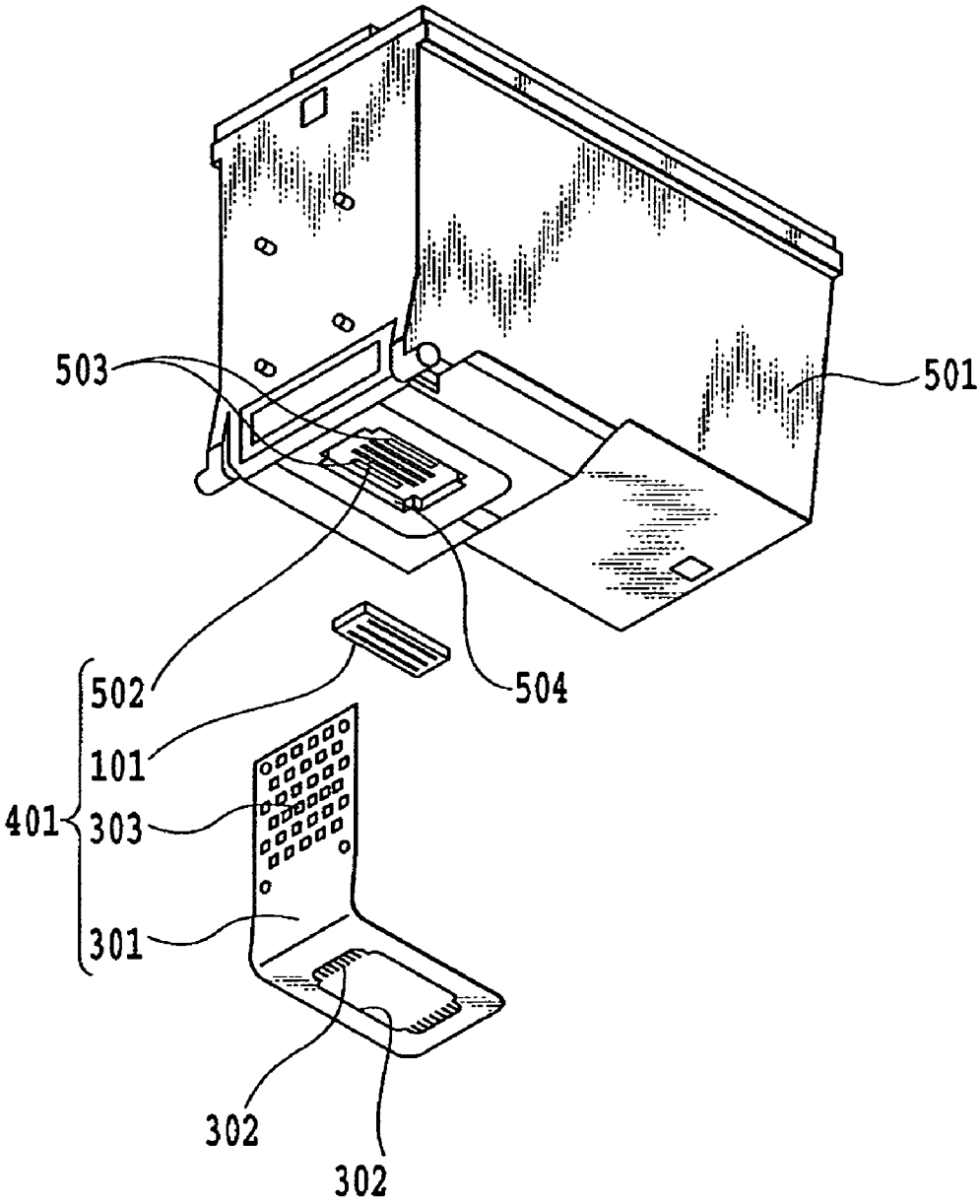
FIG. 1 is a perspective view showing a printing cartridge, in which a printing head according to Embodiment 1 of the invention and an ink container portion are integrally composed, particularly with the printing head portion disassembled.
Figure 2:
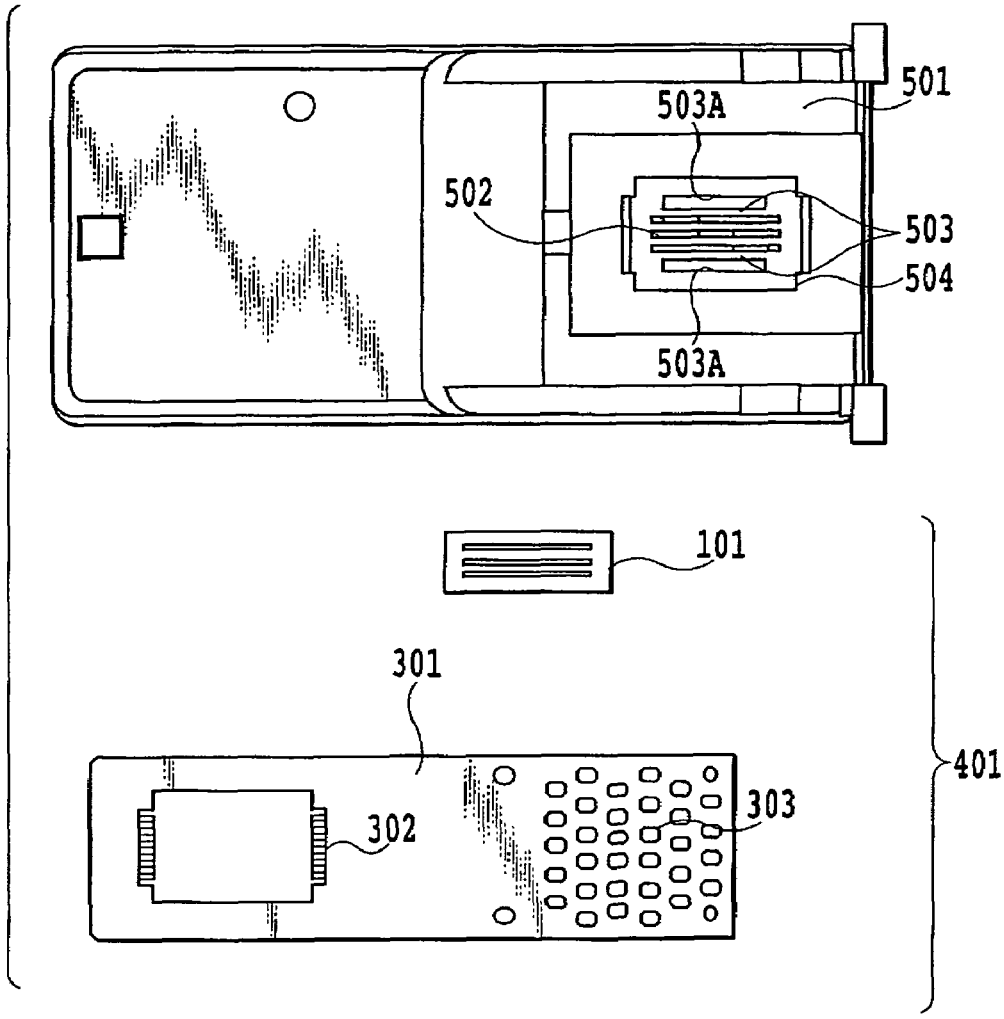
FIG. 2 is a plan view showing the printing head shown in FIG. 1 and its members.
Figure 3A:
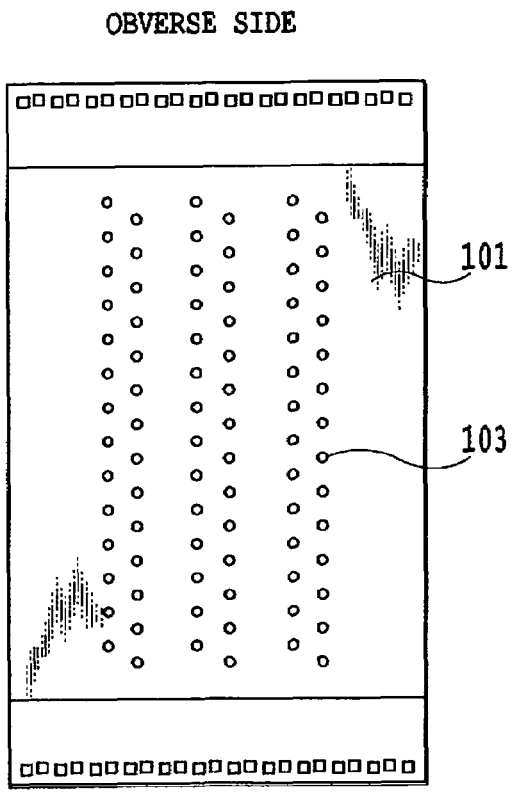
FIGS. 3A and 3B are plan views showing the surface and the rear side of the printing element substrates that compose the printing head.
Figure 3B:
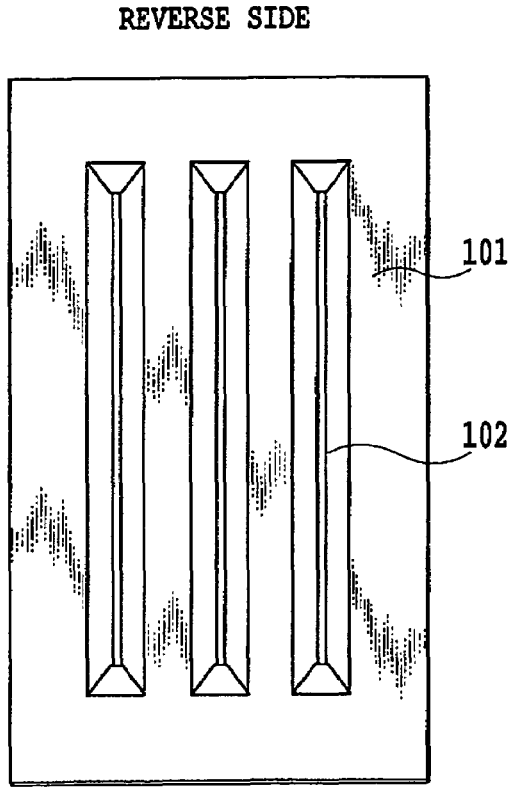
Figure 4:
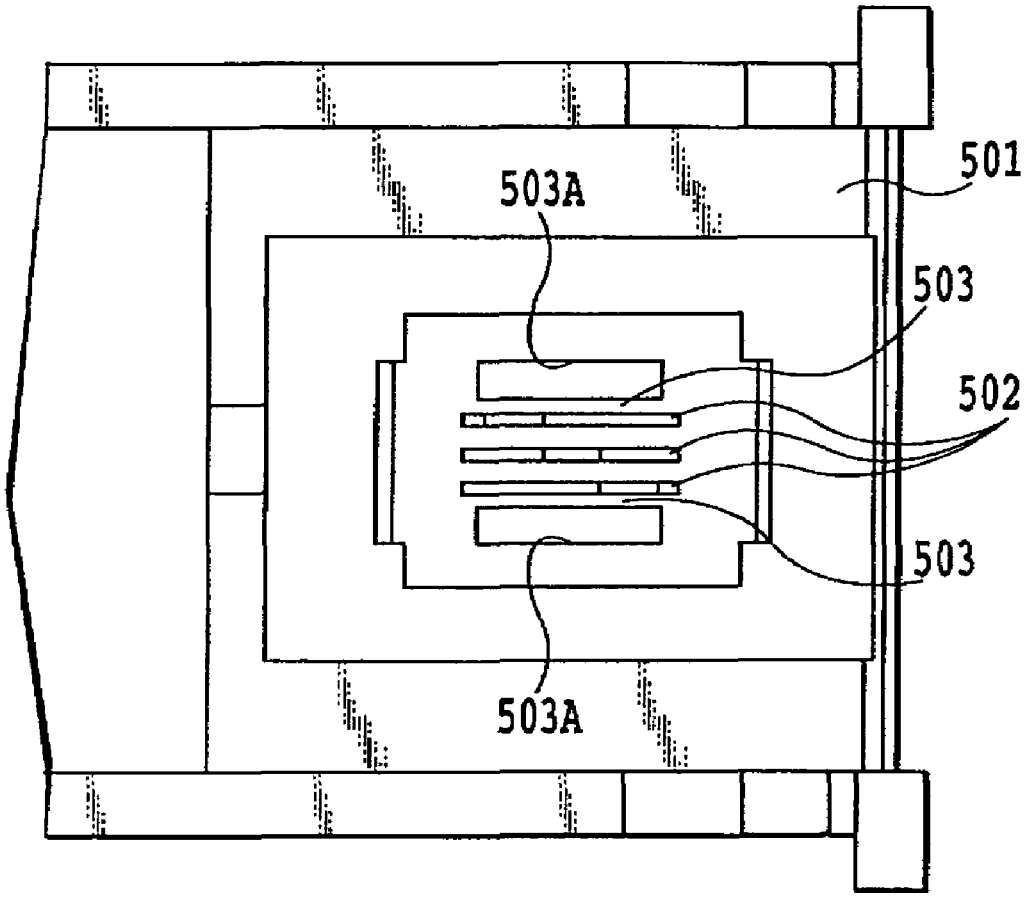
FIG. 4 is a plan view showing details of the printing element substrate in the printing head.

FIG. 1 through FIG. 4 are views showing a composition of a printing head. Of these, FIG. 1 is a perspective view showing a printing cartridge, in which a printing head portion and an ink container portion are integrally composed, particularly with the printing head portion disassembled. FIG. 2 is a plan view showing the printing head and its members. FIGS. 3A and 3B are plan views showing the surface and the rear side of the printing element substrates that compose the printing head. FIG. 4 is a plan view showing details of the printing element substrate in the printing head.

In these drawings, the printing element substrate 101 is a plate made of a silicon (Si) material whose thickness is 0.62 mm. A plurality of electro-thermal conversion elements (not shown) operating as energy generating elements for ejecting ink and electric wiring (not shown) such as Al for supplying power to the respective electro-thermal conversion elements are formed on one side of the plate by means of a film-forming technology. Further, a nozzle plate 103 (FIG. 3A), on which a plurality of ink paths (not shown) corresponding to the electro-thermal conversion elements and a plurality of ink ejection orifices are formed, is formed on the printing element substrate 101 by means of a photo-lithography technology. In line therewith, ink-supplying openings 102 (FIG. 3B) for supplying ink to a plurality of ink paths are formed so as to open on the rear side at the opposite side.

The electric wiring substrate 301 is provided with a device hole (not shown) for incorporating the printing element substrates 101, electrode terminals 302 corresponding to the electrodes (not shown) of the printing element substrate 101, and external signal input terminals 303 for receiving drive control signals from a printer main body unit, wherein the external input terminals 303 are coupled to the electrode terminals 302 by copper foil.

A supporting member 501 is formed by resin molding, and a resin material used in the present embodiment is a material in which a glass filler is blended at the ratio of 35% in order to improve shape stiffness. The supporting member 501 includes an ink-supplying path 502 from an ink storing portion (not shown). In addition, a rib 503 described later is provided at the connection surface 504 of the supporting member 501 and the printing element substrate 101. Since, in the embodiment, the adhering accuracy of the printing element substrate is comparatively high, the rib 503 secured on the supporting member 501 has a shorter width than the width of the ejection orifice array in the printing element substrate 101, and is provided at a height of 0.5 mm.

Figure 5:
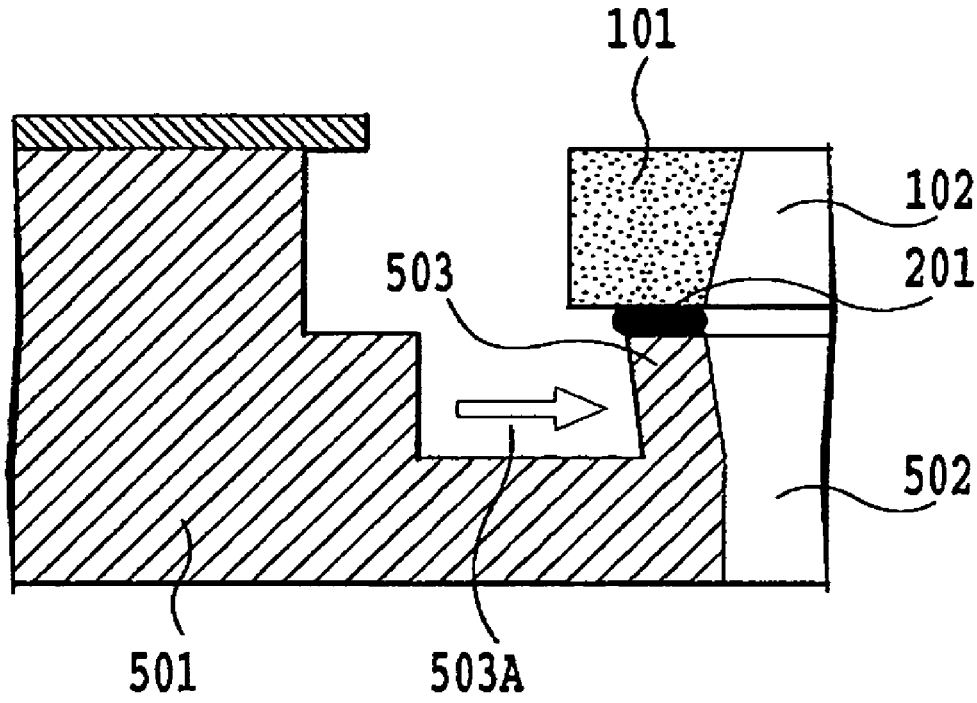
FIG. 5 is a sectional view schematically showing a part of the connection portion of the supporting member 501 and the printing element 101 in the printing cartridge shown in FIG. 1 through FIG. 4.

FIG. 5 is a sectional view schematically showing a part of the connection portion of the supporting member 501 and the printing element 101 in the print cartridge shown in FIG. 1 through FIG. 4.

As shown in FIG. 5, the printing element substrate 101 is adhered to and fixed at the supporting member 501 via a thermo-hardening type adhesive agent 201. It is preferable that the adhesive agent 201 has a low viscosity and a low hardening temperature, is hardened in a short time and is resistant against ink. In the embodiment, a thermo-hardening type adhesive agent whose main constituent is epoxy resin is employed as the adhesive agent 201. Where the thermo-hardening type adhesive agent 201 is used, the thickness of the adhering layer is 50 μm or so. And, such an adhesive agent as can bring about a desired performance such as ink-resistant performance and adhering performance by curing for one hour at 100° C. is used as the thermo-hardening type adhesive agent. The use condition and dimension of the adhesive agent are not limited thereto. They may be subjected to other conditions as long as the adhesive agent can meet the conditions required for respective ink jet printing heads.

As for connection between the printing element substrate 101 and the supporting member 501 using the above-described adhesive agent, as described below, the rib 503 is in an inclined state toward the outside of the printing element substrate 101 in the state of a final product after connection. The rib 503 is provided by forming a rectangular groove 503A at a portion to which the surface of the supporting member 501 connected to the printing element substrate 101 extends. That is, a dividing portion (for example, refer to FIG. 4) for dividing two hollow portions of the groove 503 and ink-supplying path 502 formed on the supporting member 501 as well makes up the rib 503.

Figure 6A:
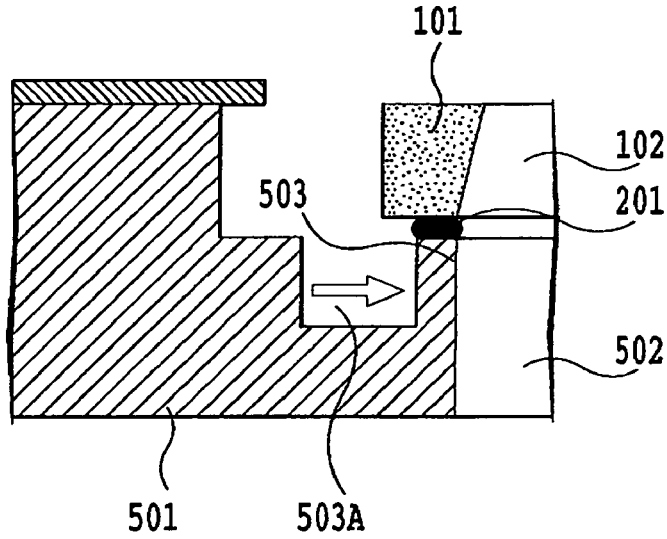
FIGS. 6A and 6B are views showing the functions of a rib 503 carried out in respect to actions of stress in line with expansion or contraction due to heat of the printing element substrate 101 shown in FIG. 5 and the supporting member 501 shown therein.

FIG. 6A and FIG. 6 Bare views illustrating the functions of a rib 1503 carried out in an action of stress in line with expansion or shrinkage of the printing element substrate 101 and the supporting member 501 due to heat, and are cross-sections similar to FIG. 5.

When producing a printing head according to the present embodiment, first, the adhesive agent 201 is coated on the resin-made supporting member 501, and the printing element substrate 101 is adhered thereto. The adhering sequence is not limited thereto. After that, the supporting member 501 having the printing element substrate 101 adhered thereto is placed in an oven whose temperature is 100° C., in order to harden the adhesive agent 201. At this time, respective component members of the printing head expand upon receiving a change in temperature from the room temperature to 100° C. The expansion ratio differs due to the linear expansion ratios of the respective component members. The linear expansion ratios of materials used in the embodiment are as follows. The linear expansion coefficient of a silicon-made printing element substrate 101 is approximately 3 ppm or so, and the linear expansion coefficient of a resin-made supporting member 501 is approximately 20 through 60 ppm or so. Therefore, the members are fixed in states expanded with respective expansion coefficients in line with hardening of the adhesive agent 201. After hardening, the printing head is taken out from the oven, and the temperature is lowered to a temperature, for example, 25° C., which is the same as the room temperature. At this time, the respective component members of the printing member are caused to contract and attempt to return to the original dimensions.

Herein, it is assumed that the linear expansion coefficient of the resin material of the supporting member 501 is 40 ppm, the linear expansion coefficient of the printing element substrate 101 is 3 ppm, and the width of the portion where the printing element substrate is adhered to the supporting member is 3 mm. In this case, when the temperature changes from 100° C. to 25° C., the supporting member tries to change in a dimension larger and a difference, which is equivalent to approximately 8.4 μm, in the dimensional change arises among the respective members. Resultantly, stress acts on the printing element substrate in the direction along which the supporting member 501 causes the printing element substrate 101 to shrink by the above-described dimension. In this case, in the prior art printing head described above in FIG. 10, particularly, the printing element substrate is deformed by the above-described stress, thereby resulting in such problems which are a lowering in the quality of printing images and damage of the printing head.

Figure 6B:
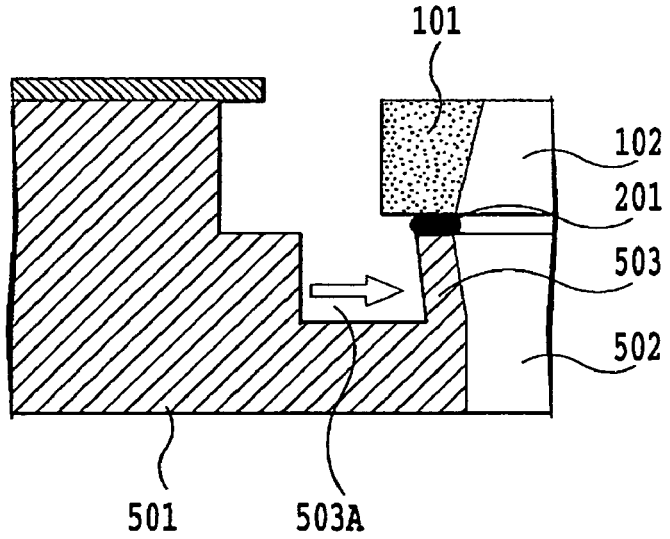

To the contrary, as shown in FIG. 6A, in the present embodiment, the supporting member 501 and the printing element substrate 101 are attached and fixed in their expanded states in a state where the adhesive agent 201 is hardened at a temperature of 100° C. Then, as the temperature of the supporting member 501 and the printing element substrate 101 is lowered to the room temperature (25° C.), the supporting member 501 shrinks greater than the printing element substrate 101 by approximately 8.4 μm as described above, and the stress relation described above arises. At this time, as shown in FIG. 6B, the rib 503 is deformed in the direction along which it receives stress, that is, in the direction of widening the rib itself, which is the direction toward the outside of the printing element substrate. This can cause a deformation difference equivalent to approximately 8.4 μm described above to be absorbed, and can cause influence of the stress onto the printing element substrate 101 to be relieved. As a result, influence onto the ink jet printing head due to use of a thermo-hardening type adhesive agent can be suppressed to such a level that does not constitute any problem. Thus, in the product of a printing head or a print cartridge (at the room temperature), the rib 503 is kept inclined toward the outside.

Further, when using the printing head or the print cartridge produced as described above for a printing operation, the temperature of the printing head rises in line with an ejecting action of ink. Then, a stress relation opposite to the above acts on the printing element substrate and the supporting member, respectively. In this case, the rib 503 is dynamically deformed (that is, the deformation is returned to the original state as the temperature is lowered), and the stress is absorbed as well. Accordingly, it is possible to prevent the printing element substrate 101, etc., from being subjected to deformation.

Figure 10:
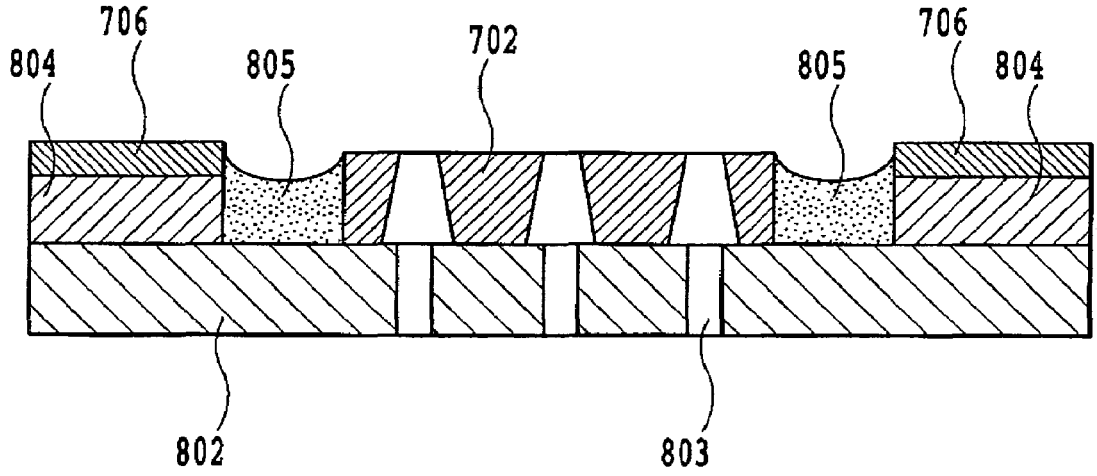
FIG. 10 is a sectional view taken along the line X-X in FIG. 9A.

Table 1 shows a comparison in regard to the landing position of ink and the presence of damage in the embodiment according to the invention, the prior art example shown in FIG. 10, and an example in which the rigidity is increased ten times by increasing the area of the printing element substrate in the above-described prior art example, before and after carrying out an H/C test (a fluctuation in temperature from −30° C. to 60° C. is repeated ten cycles).

TABLE 1

| | Before H/C | | After H/C (10 cycles) | |
|---|---|---|---|---|
| | Shift in landing position | Damage | Shift in landing position | Damage |
| Prior art example | 40 μm | Yes | 120 μm | Yes |
| Increased area (Rigidity ten times) | 10 μm | No | 20 μm | No |
| Embodiment of the invention | 10 μm | No | 10 μm | No |

As shown in Table 1, since the printing head according to the embodiment of the invention is provided with the rib 503, the shift of the ink landing position is very slight before and after the H/C test, and there is no case where the printing element substrate and the supporting member are subjected to any damage.

Further, in the above-described example of the present embodiment, it was assumed that a thermo-hardening type adhesive agent which is hardened at a high temperature is used. However, the adhesive agent is not limited thereto. In a mode where the printing element substrate 101 and the supporting member 501 are adhered to each other by means of a low temperature (room temperature) hardening type adhesive agent, the invention may be applicable as in the case of temperature rise due to the above printing operations.

That is, if the temperature of the ink jet printing head rises during a printing operation, the printing element substrate 101 and the supporting member 501 expand to cause their dimensions to be increased. Since the supporting member 501 is made of a resin material, the linear expansion ratio thereof is larger than that of the printing element substrate 101. Therefore, as the printing head temperature rises during a printing operation, a difference is caused to be present in the dimensional changes of the printing element substrate 101 and the supporting member 501. However, as described above, since the rib 503 is provided on the adhered surface 504, which the supporting member 501 has, the rib 503 absorbs the stress caused by the thermal stress by dynamic deformation thereof, and then influence onto the printing element substrate 101 can be relieved.

Embodiment 2

In cases where the adhering accuracy of the printing element substrate is not very severe and no provisional fixing is required, it is possible to lengthen the length of the rib described above. Accordingly, for example, in such substrates in which the distance between the ink-supplying port formed on the printing element substrate and the end face of the substrate is comparatively small (that is, a narrow printing element substrate), it is possible to effectively relieve the stress due to a difference in linear expansion.

In addition, in the first embodiment shown in FIG. 4, since a rib which is shorter than the width of the ejection orifice array of the printing element substrate 101 is provided, positioning is enabled at a portion where the printing element substrate 101 and the rib 503 is not adhered and fixed. Accordingly, it becomes possible to improve the adhering position accuracy of the printing element substrate.

Figure 7:
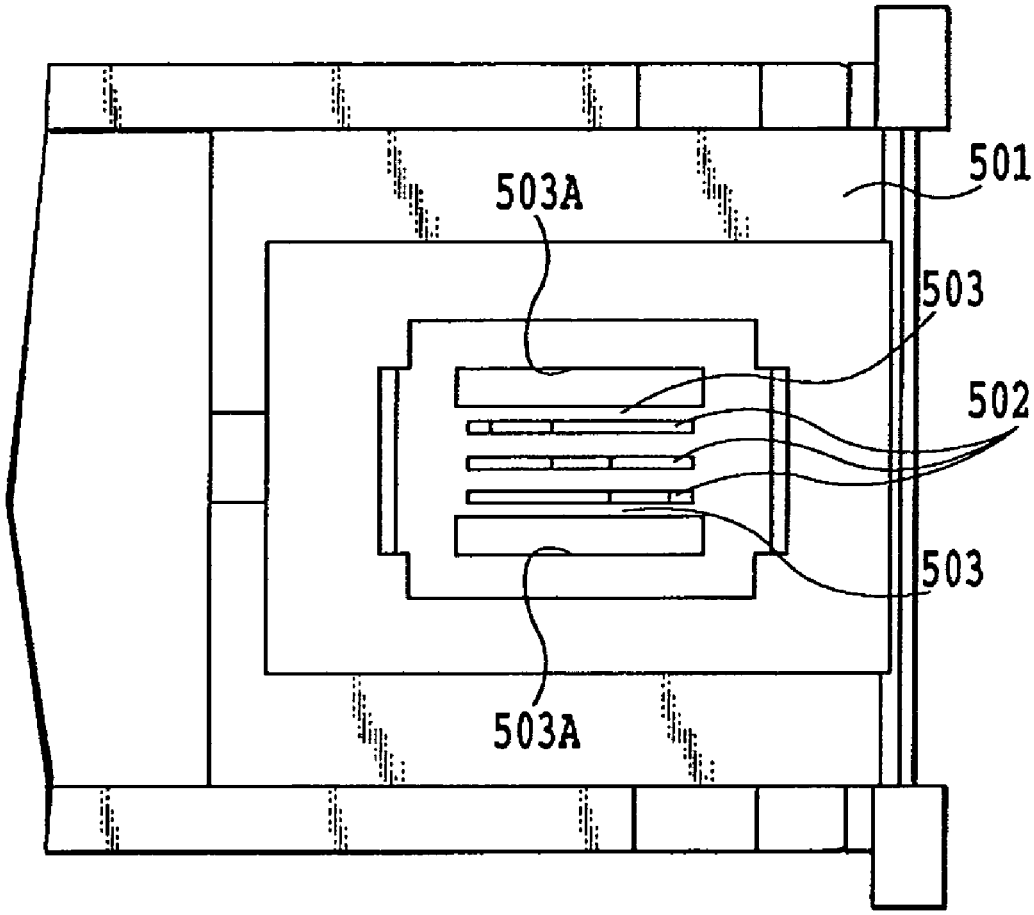
FIG. 7 is a plan view showing a printing head according to Embodiment 2 of the invention.

In the present embodiment, as shown in FIG. 7, by providing the ribs 503 as in the first embodiment, stress based on a difference in the linear expansion ratios of the printing element substrate 101 and the supporting member 501 can be absorbed by deformation in the direction along which the rigidity of the printing element substrate 101 is weak.

In addition, by providing the rib longer than the width of the ink ejection orifice array of the printing element substrate 101, it is possible to further reduce the area where the printing element substrate receives the stress.

Figure 8:
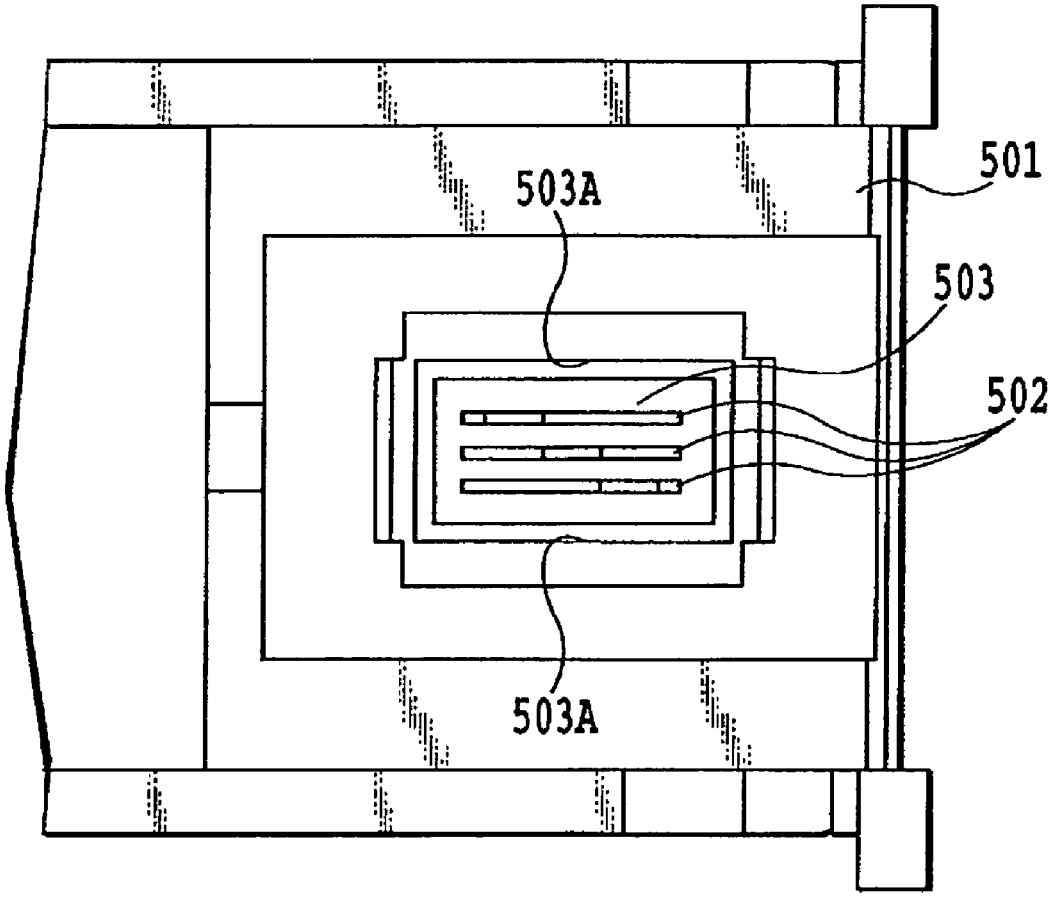
FIG. 8 is a plan view showing a printing head according to another embodiment of the invention.
Figure 9A:
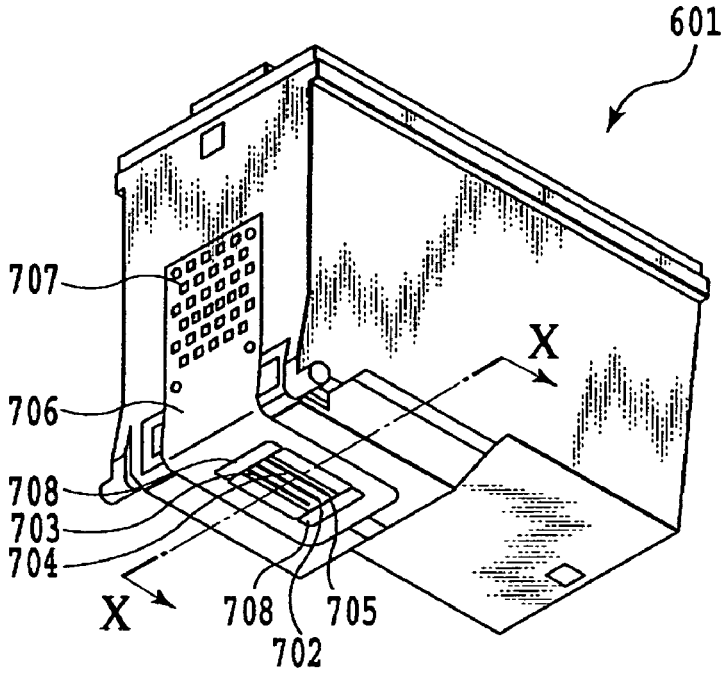
FIGS. 9A and 9B are perspective views showing a printing cartridge, in which a printing head and an ink container according to a prior art are integrally composed, when being observed from the downside and upside on which nozzles are provided, respectively.
Figure 9B:
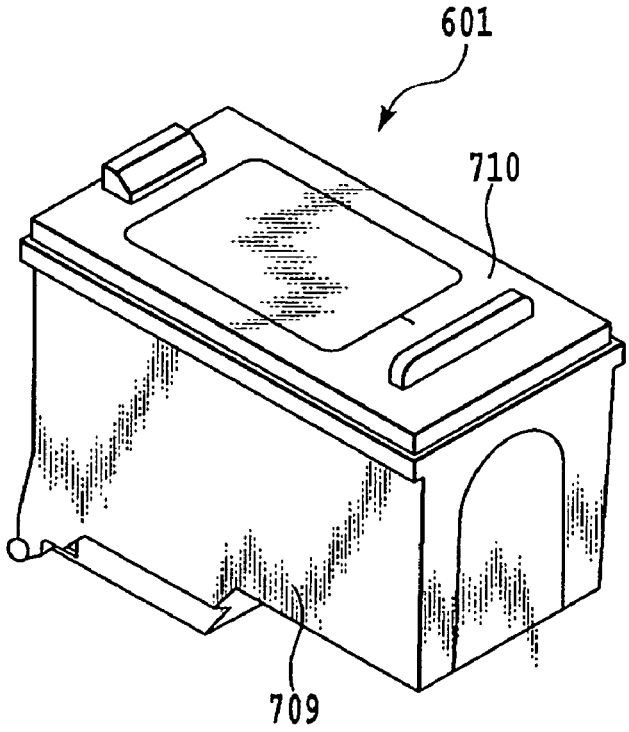

Also, it is possible to provide ribs so as to surround the entire ink-supplying paths 502 as shown in FIG. 8. Accordingly, the stress based on a difference in the linear expansion ratios of the printing-element substrate 101 and the supporting member 501 can be absorbed by greatly deforming the ribs 503.

Further, where, in the future, multiple colors are dealt with, the size of the printing element substrate is increased, or the size thereof is decreased, it is presumed that the rigidity of the printing element substrate will be decreased by narrowing of the clearance between the ink-supplying paths in line with an increase in the number of the ink-supplying paths for the printing element substrate. In this case, by providing ribs according to the embodiment of the invention, it is possible to relieve the deformation of the printing element substrate with respect to heat.

Another Embodiment

In the respective embodiments described above, where the thermo-hardening type adhesive agent is used, the ribs remain inclined in the state of the product. However, the application of the invention is not limited to this aspect.

For example, when the adhesive agent is hardened as described in FIG. 6A, contrary to a state where the rib 503 is inclined to the left side, the rib 503 is formed to be inclined to the right side, and rib 503 is caused to be almost erect in the state shown in FIG. 6B, that is, in the state of the product.

In addition, the printing head provided with the above-described construction is mounted on a carriage of an ink jet printing apparatus as a printing cartridge shown in FIG. 1, and is used for printing. That is, the printing head scans a printing medium by movement of the carriage, and ejects ink onto the printing medium during the scanning. And, printing is carried out by repeating transfer of the printing medium by a predetermined distance and scanning as well.

According to the embodiments described above, a rib for dividing a hollow portion formed inside a supporting member from the outside of the corresponding supporting member is provided at a part of the portion where the corresponding supporting member is adhered to the printing element substrate, and the printing element substrate is adhered in a state where the upper surface of the corresponding rib inclines in the direction toward the outside of the printing element substrate. Thus, even if the temperature acting on the printing head changes to cause the dimensions of the printing element substrate and the supporting member to be changed, and stress mutually acts on both thereof, the stress can be absorbed by deformation of the rib, wherein it is possible to relieve the stress applied to the printing element substrate. As a result, it becomes possible to prevent the printing element substrate from being deformed and damaged.

In addition, in a preferred embodiment, where, in regard to the materials of the supporting member and the printing element substrate, the linear expansion ratio of the supporting member is larger than that of the printing element substrate, it becomes possible to relieve the stress by deformation of the rib.

Further, since the rib is provided roughly in parallel to the array of the ink ejection orifices provided on the printing element substrate, it becomes possible to relieve the printing element substrate from being greatly deformed due to not resisting the stress generated.

Further, since the rib is provided in the supporting member with a shorter width than the width of the array of the ink ejection orifices provided in the printing element substrate, the printing element substrate portion that is not adhered to the rib can be positioned, wherein it is possible to improve the adhering accuracy of the printing element substrate.

Still further, since the rib is provided with a longer width than the width of the row of the ink ejection orifices secured in the printing element substrate, the area for receiving the stress can be reduced, wherein it is possible to relieve the printing element substrate from being greatly deformed and damaged.

In addition, since the rib is formed so as to surround all the ink-supplying paths, the rib can be greatly deformed, wherein it is possible to relieve the stress to which the printing element substrate is subjected.

Based on the above, an inexpensive printing head of a simple structure can be provided, which can bring about stabilized printing quality without accompanying any increase in the production cost of the printing head.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

This application claims priority from Japanese Patent Application No. 2005-200148 filed Jul. 8, 2005, which is hereby incorporated by reference herein.

What is claimed is:

1. A printing head formed by adhering a printing element substrate, provided with an energy generating element for generating energy used for ejecting ink, to a supporting member, where a linear expansion ratio of the supporting member is greater than that of the printing element substrate, said printing head comprising:

a rib for dividing an ink supply path formed inside the supporting member for supplying ink from outside of the supporting member, said rib being provided at a part of a portion where the supporting member is adhered to the printing element substrate and being continuously formed along a portion from one end to the other end of the ink supply path, wherein the printing element substrate is adhered to the supporting member in a state where an upper surface of said rib inclines in a direction toward an outside of the printing element substrate, and said rib is deformable according to a temperature change of the supporting member.

2. A printing head as claimed in claim 1, wherein said rib is formed with said rib surrounding the ink supply path provided in the printing element substrate.

3. A printing head formed by adhering a printing element substrate, provided with an energy generating element for generating energy used for ejecting ink, to a supporting member, in which an ink supply path for supplying ink to the printing element substrate is provided, where a linear expansion ratio of the supporting member is greater than that of the printing element substrate, said printing head comprising:

a rib for dividing the ink supply path formed inside the supporting member for supplying ink from the outside of the supporting member, said rib being provided at a part of a portion where the supporting member is adhered to the printing element substrate and being continuously formed along a portion from one end to the other end of the ink supply path to be deformable.

4. A printing head as claimed in claim 3, wherein said rib is provided with a width of said rib being longer than a length of an array of ink ejection orifices provided in the printing element substrate.

5. A printing head as claimed in claim 3, wherein said rib is formed with said rib surrounding the ink supply path provided in the printing element substrate.

6. An ink jet printing apparatus using a printing head claimed in any one of claims 1, 3, 4, 2, and 5, to eject ink to a printing medium from the printing head for performing printing.

* * * * *